United States Patent [19]

Nilssen

[11] Patent Number: 4,935,669

[45] Date of Patent: Jun. 19, 1990

[54] TWO-MODE ELECTRONIC BALLAST

[76] Inventor: Ole K. Nilssen, Caesar Dr., Barrington, Ill. 60010

[21] Appl. No.: 145,925

[22] Filed: Jan. 20, 1988

[51] Int. Cl.[5] ..... H05B 41/29

[52] U.S. Cl. ..... 315/105; 315/205; 315/209 R; 315/278; 315/DIG. 5; 315/DIG. 7

[58] Field of Search ..... 315/DIG. 5, 209 R, 291, 315/DIG. 7, 205, 278, 105

[56] References Cited

U.S. PATENT DOCUMENTS

| | | | |
|---|---|---|---|
| 4,538,093 | 8/1985 | Melai | 315/DIG. 5 |
| 4,588,924 | 5/1986 | Luursema | 315/DIG. 5 |
| 4,719,390 | 1/1988 | Sairanen | 315/DIG. 5 |
| 4,746,841 | 5/1988 | Ogawa | 315/DIG. 5 |

*Primary Examiner*—Eugene R. LaRoche
*Assistant Examiner*—Michael B. Shingleton

[57] ABSTRACT

A self-oscillating inverter-type fluorescent lamp ballast has two modes of operation: (a) a first mode in which the inversion frequency is about 70 kHz and is resonant with a first tuned circuit by which power is supplied to the cathodes of the fluorescent lamp; and (b) a second mode in which the inversion frequency is about 30 kHz and is resonant with a second tuned circuit by which main lamp power is supplied. When the ballast is initially powered-up, it starts operation in its first mode, thereby providing cathode heating power without yet providing main lamp power. About one second later, after the cathodes have reached full incandescence, the inverter automatically changes into its second mode, thereby providing main lamp power while at the same time removing cathode heating power. If for some reason the lamp were not to ignite within about 10 milliseconds, the inverter reverts back into its first mode; thereafter cycling between its two modes until the lamp does ignite.

16 Claims, 1 Drawing Sheet

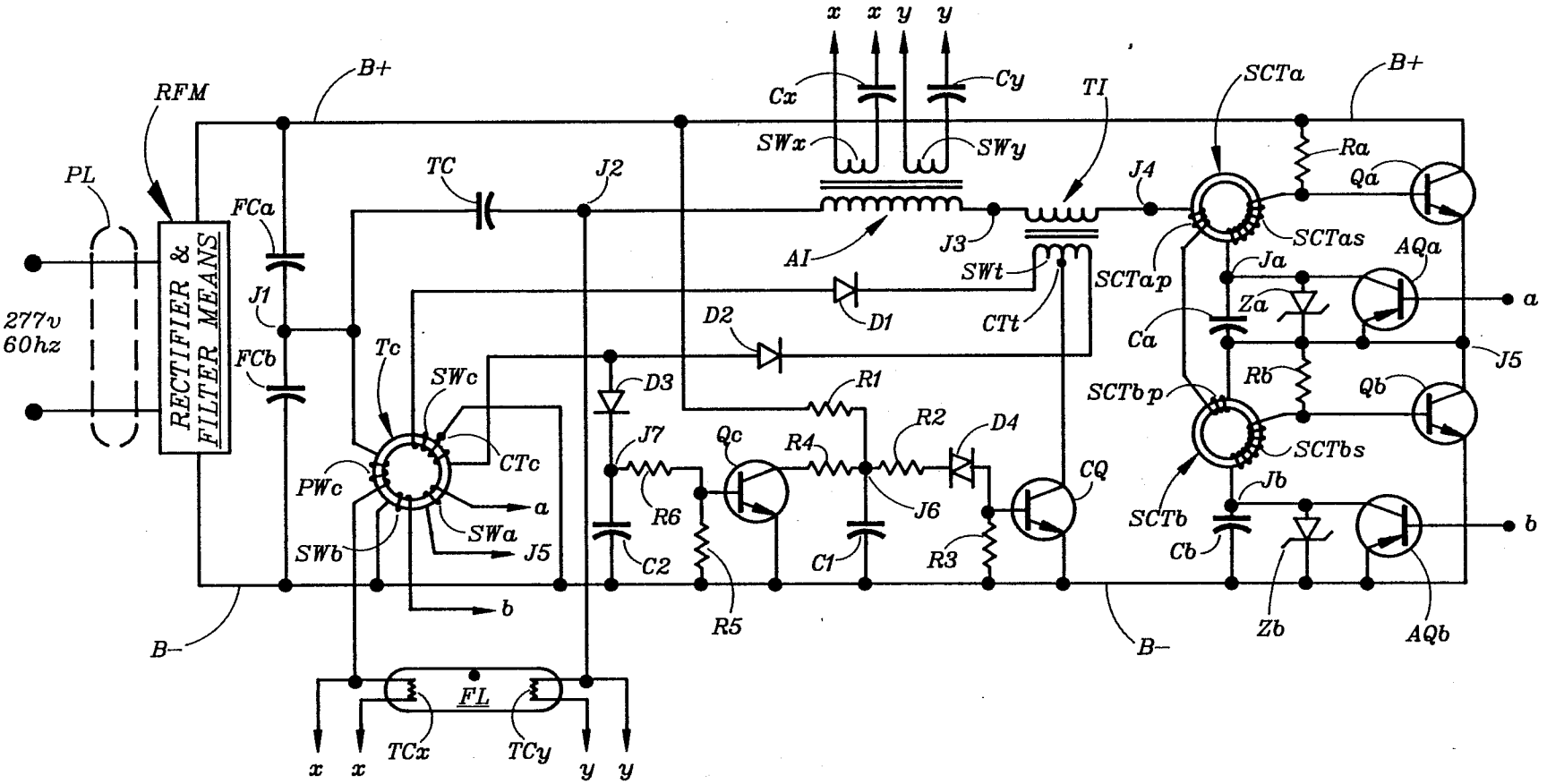
RECTIFIER & FILTER MEANS
277v 60hz
PL
RFM
B+
B-
FCa
J1
FCb
TC
J2
Tc
SWc
CTc
PWc
SWb
SWa
J5
a
b
TCy
FL
TCx
x
y
D3
J7
R6
C2
R5
Qc
R4
R1
D2
D1
AI
R2
J6
D4
R3
C1
CQ
J3
SWx
Cx
SWy
Cy
TI
CTt
SWt
J4
SCTap
SCTa
Ca
SCTbp
SCTb
Cb
Zb
Jb
Rb
Za
Ja
SCTas
SCTbs
Ra
Qa
AQa
Qb
AQb

TWO-MODE ELECTRONIC BALLAST

BACKGROUND OF THE INVENTION

1. Field of the Invention

The present invention relates to electronic ballasts for gas discharge lamps, particularly to ballasts wherein the load is powered by way of a series-excited parallel-loaded resonant L-C circuit.

2. Description of Prior Art

There are two predominant types of electronic ballasts for gas discharge lamps: (a) a first type may be referred-to as the parallel-resonant type and involves the use of a current-excited (i.e., parallel-excited) parallel-loaded resonant L-C circuit; and (b) a secnd type that may be referred-to as the series-resonant type and involves the use of a voltage-excited (i.e., series-excited) parallel-loaded resonant L-C circuit.

An example of the parallel-resonant type of electronic ballasts is described in U.S. Pat. No. 4,277,726 to Burke. An example of the series-resonant type of electronic ballasts is described in U.S. Pat. No. 4,538,095 to Nilssen.

Of these two types of electronic ballasts, the parallel-resonant type is conducive to yielding a stable easy-to-control self-oscillating inverter-type ballast; whereas the series-resonant type, although potentially simpler and more efficient, is harder to control in that it has a natural tendency to self-destruct in case the lamp load be removed.

To mitigate this tendency to self-destruct under no-load conditions, various protection circuits have been developed, such as for instance described in U.S. Pat. No. 4,638,562 to Nilssen.

GENERAL PURPOSE OF PRESENT INVENTION

The general purpose of the present invention is that of providing a method for cost-effectively controlling the operation of a series-resonant electronic inverter-type ballast for fluorescent lamps.

SUMMARY OF THE INVENTION

1. Objects of the Invention

An object of the present invention is the provision of a cost-effective control arrangement for attaining proper operation of an electronic ballast wherein the lamp load is powered by way of a series-excited predominantly parallel-loaded resonant L-C circuit.

This as well as other objects, features and advantages of the present invention will become apparent from the following description and claims.

2. Brief Description

A self-oscillating inverter-type fluorescent lamp ballast has two modes of operation: (a) a first mode in which the inversion frequency is about 70 kHz and is resonant with a first tuned L-C circuit by which power is supplied to the cathodes of the fluorescent lamp; and (b) a second mode in which the inversion frequency is about 30 kHz and is resonant with a second tuned L-C circuit by which main lamp power is supplied.

When the ballast is initially powered-up, it starts operation in its first mode, thereby providing cathode heating power without yet providing main lamp power. About one second later, after the cathodes have reached full incandescence, the inverter automatically changes into its second mode, thereby providing main lamp power while at the same time removing cathode heating power. If for some reason the lamp were not to ignite within about 10 milli-seconds, the inverter reverts back into its first mode; thereafter cycling (with a period of about one second) between its two modes until the lamp does ignite.

Thus, the first tuned L-C circuit is resonant at 70 kHz; and, due to inherent frequency-selectivity characteristics, this first tuned circuit provides cathode heating power only when being excited at or near 70 kHz. Likewise, the second tuned L-C circuit provides main lamp starting voltage and operating power only when being excited at or near 30 kHz.

BRIEF DESCRIPTION OF THE DRAWING

The drawing diagrammatically illustrates the circuit arrangement of the invention in its preferred embodiment.

DESCRIPTION OF THE PREFERRED EMBODIMENT

1. Details of Construction

The drawing schematically illustrates the preferred embodiment of the invention in the form of a half-bridge inverter-type two-mode electronic ballast for a fluorescent lamp.

In the drawing, 277 Volt/60 Hz power line voltage from an ordinary electric utility power line PL is provided to the AC power input terminals of a rectifier and filter means RFM, the DC output from which is applied between a B+ bus and a B− bus.

A filter capacitor FCa is connected between the B+ bus and a junction J1; a filter capacitor FCb is connected between junction J1 and the B− bus. A tank capacitor TC is connected between junction J1 and a junction J2. An auxiliary inductor AI is connected between junction J2 and a junction J3; and a main tank inductor TI is connected between junction J3 and a junction J4.

Junction J4 is connected with a junction J5 by way of series-connected primary windings SCTap and SCTbp of saturable current transformers SCTa and SCTb, respectively.

A first main inverter transistor Qa is connected with its collector to the B+ bus and with its emitter to junction J5; a second main inverter transistor Qb is connected with its collector to junction J5 and with its emitter to the B− bus.

Secondary winding SCTas of saturable current transformer SCTa is connected between the base of transistor Qa and a junction Ja. A capacitor Ca is connected between junctions Ja and J5. A Zener diode Za is connected with its anode to junction Ja and with its cathode to junction J5. An auxiliary transistor AQa is connected with its collector to junction Ja and with its emitter to junction J5. A resistor Ra is connected between the B+ bus and the base of transistor Qa. The base of auxiliary transistor AQa is designated a.

Secondary winding SCTbs of saturable current transformer SCTb is connected between the base of transistor Qb and a junction Jb. A capacitor Cb is connected between junction Jb and the B− bus. A Zener diode Zb is connected with its anode to junction Jb and with its cathode to the B− bus. An auxiliary transistor AQb is connected with its collector to junction Jb and with its emitter to the B− bus. A resistor Rb is connected between junction J5 and the base of transistor Qb. The base of auxiliary transistor AQb is designated b.

Tank inductor TI has a secondary winding SWt, which has a center tap CTt connected with the collector of a control transistor CQ. The emitter of control transistor CQ is connected with the B— bus.

The terminals of secondary winding SWt are connected with the cathodes of two diodes D1 and D2; whose anodes are connected with the terminals of a secondary winding SWc of a control transformer Tc; which secondary winding has a center tap CTc connected with the B— bus.

A fluorescent lamp FL has two thermionic cathodes TCx and TCy; which has power input terminals x—x and y—y, respectively. One of the power input terminals of cathode TCx is connected with junction J1 by way of primary winding PWc of control transformer Tc. One of the power input terminals of cathode TCy is connected with junction J2.

Power input terminals x—x and y—y of cathodes TCx and TCy are connected with power output terminals x—x and y—y of secondary windings SWx and SWy of auxiliary inductor AI, all respectively; which secondary windings have series-connected capacitors Cx and Cy, also respectively.

A resistor R1 is connected between the B+ bus and a junction J6; and a capacitor C1 is connected between junction J6 and the B— bus. A resistor R2 and a Diac D4 are connected in series between junction J6 and the base of control transistor CQ. A resistor R3 is connected between the base of transistor CQ and the B— bus.

A resistor R4 is connected between junction J6 and the collector of a transistor Qc, whose emitter is connected with the B— bus. A resistor R5 is connected between the base of transistor Qc and the B— bus. A resistor R6 is connected between the base of transistor Qc and a junction J7. A capacitor C2 is connected between junction J7 and the B— bus. A diode D3 is connected with its anode to the anode of diode D2 and with its cathode to junction J7.

Control transformer Tc also has two secondary windings SWa and SWb. The terminals of secondary winding SWa are connected between base a of transistor AQa and junction J5; the terminals of secondary winding SWb are connected between the B— bus and base b of transistor AQb.

2. Details of Operation

The operation of the circuit arrangement schematically illustrated by the drawing may be explained as follows.

In the arrangement of the drawing, ordinary 277 Volt/60 Hz power line voltage is provided from the power line (PL) and is rectified and filtered by conventional rectifier and filter means RFM such as to provide a DC voltage between the B+ and the B— buses, with the B+ bus carrying the positive polarity.

The half-bridge inverter, which principally consists of capacitors FCa and FCb, transistors Qa and Qb, and saturable current feedback transformers SCTa and SCTb, is self-oscillating and functions in a substantially ordinary manner, such as for instance described in conjunction with FIG. 8 of U.S. Pat. No. Re. 31,758 to Nilssen.

The output of the half-bridge inverter is provided to and between junctions J1 and J4; between which junctions are connected in series: tank capacitor TC, tank inductor TI, and auxiliary inductor AI.

Auxiliary inductor AI is tuned to about 70 kHz by way of capacitors Cx and Cy; which two capacitors are connected with the secondary windings of the auxiliary inductor as well as with the loads connected to the output of these secondary windings. Thus, only when lamp cathodes TCx and TCy are indeed connected with the two secondary windings is the auxiliary inductor tuned to about 70 kHz. As a result, at about 70 kHz, the auxiliary inductor appears like a parallel-resonant circuit as viewed from between junctions J2 and J3.

Tank inductor TI is tuned to series-resonate with tank capacitor TC at about 30 kHz; which is to say that the total impedance between junctions J1 and J4 appears substantially like a series-resonant circuit at about 30 kHz.

At 30 kHz, the impedance of auxiliary inductor AI is inductive and relatively small, and is at that frequency simply considered as a small part of tank inductor TI.

At 70 kHz, the impedance of tank capacitor TC is capacitive and relatively small, whereas the impedance of tank inductor TI is inductive and relatively high.

Thus, when the inverter oscillates at 70 kHz, its output voltage is applied by way of high-impedance tank inductor TI to the parallel-resonant circuit represented by auxiliary inductor AI; which parallel-resonant circuit then operates to power the two thermionic cathodes of fluorescent lamp FL. During this mode, the power provided to these two cathodes is about two watts, and the magnitude of the current then drawn from the inverter output is quite small. As a result, the magnitude of the 70 kHz voltage resulting across tank capacitor TC is very small.

On the other hand, when the inverter oscillates at 30 kHz, essentially no power is provided to the thermionic cathodes. However, at that frequency, the resonant series-tuned L-C circuit then loading the inverter's output causes a 30 kHz voltage of very large magnitude to develop across the tank capacitor. The magnitude of this 30 kHz voltage is so large as to cause the fluorescent lamp to ignite; whereafter the magnitude of the 30 kHz voltage across the tank capacitor will be determined by the current-voltage characteristices of the fluorescent lamp. In reality, at the 30 kHz series-resonance, the output provided from the output terminals to the fluorescent lamp (i.e., from junctions J1 and J2) will essentially be a 30 kHz constant-magnitude current.

The frequency of inverter oscillation is determined by the saturation characteristics of saturable current transformers SCTa and SCTb in conjunction with the magnitude of the voltage presented to their secondary windings SCTas and SCTbs.

The magnitude of the voltage presented to secondary windings SCTas and SCTbs will be determined by the base-emitter voltage of transistors Qa and Qb in combination with the magnitude of the voltage present at junctions Ja and Jb as referenced to the emitters of transistors Qa and Qb, respectively.

With no control signals provided to the bases a and b of auxiliary transistors AQa and AQb, the magnitude of the voltage at junctions Ja and Jb will be determined by the Zener voltages of Zener diodes Za and Zb; which Zener voltages are chosen to be about 4.0 Volt each. However, when sufficient control current is provided to each of bases a and b, transistors AQa and AQb become conductive and therefore operative to shunt Zener diodes Za and Zb, thereby to cause the magnitudes of the voltages at junctions Ja and Jb to become very low (about 1.0 Volt each).

Thus, absent control currents at bases a and b, the inverter will oscillate at about 70 kHz; whereas, with control currents, the inverter will oscillate at about 30 kHz.

When the inverter is initially powered-up, no lamp current is flowing through the primary winding of control transformer Tc and control transistor CQ is non-conductive; which means that no control currents are provided to bases a and b of transistors AQa and AQb. Thus, when initially powered-up, the inverter will initiate oscillations at a frequency of about 70 kHz.

However, after about one second, capacitor C1 will have reached a voltage high enough to cause Diac D4 to break down; which, in turn, causes capacitor C1 to discharge into the base of control transistor CQ, thereby causing this transistor to become conductive.

Control transistor CQ will remain conductive for a period of about 10 milli-seconds; and, during this period, current from secondary winding SWt of tank inductor TI will flow through secondary winding SWc of control transformer Tc; thereby—via secondary windings SWa and SWb on control transformer Tc—providing control currents to bases a and b of transistors AQa and AQb; thereby causing capacitors Ca and Cb to discharge to a voltage level of about 1 Volt; thereby, in turn, to cause the inverter's oscillating frequency to become about 30 kHz.

With the inverter frequency at 30 kHz, the magnitude of the voltage provided between the lamp's cathodes becomes large enough to cause lamp ignition within the 10 milli-second period; which, in turn, gives rise to the flow of lamp current; which lamp current flows through primary winding PWc of control transformer Tc, thereby continuing to provide control currents to bases a and b of transistors AQa and AQb; thereby continuing to maintain the inverter's oscillation frequency at 30 kHz.

On the other hand, if the fluorescent lamp were to fail to ignite within the 10 milli-second time-window during which the control transistor CQ be conductive, control currents to bases a and b would not be sustained; thereby causing the inverter to revert to its 70 kHz oscillating frequency.

In short, with a properly operational fluorescent lamp connected, the ballast arrangement of the drawing operates as follows.

(1) Upon initial connection to the power line, the inverter starts oscillating at a 70 kHz frequency; which, via a 70 kHz resonating circuit associated with auxiliary inductor AI, therefore causes cathode heating power to be provided to the thermionic cathodes of the fluorescent lamp.

(2) After about one second, at which time the cathodes are fully thermionic, control transistor CQ suddenly becomes conductive and thereafter remains conductive for a period of about 10 milli-seconds. With transistor CQ conductive, control current is provided to auxiliary transistors AQa/AQb; which then become conductive, thereby to cause a reduction in the magnitudes of the voltages across capacitors Ca/Cb; which, in turn, causes the frequency of inverter oscillation to reduce to 30 kHz and to remain at 30 kHz for at least 10 milli-seconds.

(3) With the inverter oscillating at 30 kHz, series-resonance occurs between tank capacitor TC and tank inductor TI (including the net inductance of auxiliary inductor AI and its associated circuitry); which series-resonance, due to so-called Q-multiplication effects, results in a high-magnitude 30 kHz voltage developing across the tank capacitor.

(4) The high-magnitude 30 kHz voltage developing across the tank capacitor is applied across the fluorescent lamp and, because its cathodes are already thermionic, causes it to ignite immediately. The resulting lamp current will then, via control transformer Tc, continue to provide control current to auxiliary transistors AQa/AQb; thereby, even after the initial 10 millisecond period, ensuring that the inverter's frequency of oscillation remains at 30 kHz.

(5) When the inverter is operating at 30 kHz, essentially no power is being delivered to the cathodes of the fluorescent lamp, thereby providing for improved energy efficiency as compared with the situation where cathode power be supplied on a continuous basis.

(6) If the lamp were to be removed or if lamp current otherwise were to fail to flow, control current would cease to be provided to auxiliary transistors AQa/AQb, thereby causing the inverter's oscillation frequency to revert to 70 kHz. Thus, as long as no lamp current is flowing, the inverter will alternate between two modes: a first mode of oscillating at 70 kHz and a second mode of oscillating at 30 kHz, spending about one second (1000 milli-seconds) at 70 kHz for each 10 milliseconds at 30 kHz.

3. Additional Comments (a) To protect against possible self-destruction of the inverter circuit (which might occur if the circuit were to operate for a period of time without being connected with a properly functioning lamp load), it may be advantageous to connect a voltage-limiting means, such as a Varistor, in parallel with the tank capacitor.

(b) For further details relative to the biasing arrangement used in connection with main inverter transistors Qa/Qb, reference is made to FIG. 3 of U.S. Pat. No. 4,307,353 to Nilssen.

(c) By providing for additional levels of adjustment for the magnitude of the bias voltage (i.e., the voltage across capacitors Ca/Cb), corresponding adjustment of the magnitude of lamp current may be attained, thereby to provide for lamp dimming.

(d) It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. An arrangement comprising:

self-oscillating inverter means connected with a source of DC voltage and operative to provide an inverter voltage at an inverter output, the inverter voltage having a frequency, the inverter means being self-oscillating by way of positive feedback means and having control means operative in response to a control input to control the self-oscillation frequency;

gas discharge lamp means having: (i) main lamp terminals operative to receive main lamp operating power, and (ii) thermionic cathode means having cathode terminals operative to receive cathode heating power;

impedance means connected in circuit between the inverter output, the main lamp terminals, and the cathode terminals, the impedance means being operative to supply from the inverter output main lamp operating power to the main lamp terminals and cathode heating power to the cathode terminals, the amount of main lamp operating power and the amount of cathode heating power supplied both being dependent on the frequency of the inverter voltage; and control means operative to provide the control input in such manner as to control the frequency of the inverter voltage, thereby to control the amount of main lamp operating power as well as the amount of cathode heating power.

2. The arrangement of claim 1 wherein: (i) the amount of cathode heating power supplied to the cathode terminals is a first function of the frequency of the inverter voltage, and (ii) the amount of main lamp operating power is a second function of the frequency of the inverter voltage, the second function being substantively different from the first function.

3. The arrangement of claim 2 wherein the amount of cathode heating power supplied decreases as the amount of main lamp operating power increases.

4. The arrangement of claim 1 wherein the impedance means comprises a first and a second tuned circuit means, the first tuned circuit means being operative to determine the amount of cathode heating power being supplied to the cathode terminals, the second tuned circuit means being operative to determine the amount of main lamp operating power being supplied to the main lamp terminals.

5. The arrangement of claim 1 combined with current sensing means connected in circuit with the main lamp terminals as well as with the control means, the current sensing means being operative to sense lamp current flowing between the main lamp terminals and, in response to this lamp current, to provide at least part of the control input.

6. The arrangement of claim 1 wherein the impedance means comprises a series-tuned L-C circuit connected across the inverter output.

7. An arrangement comprising:

inverter means connected with a source of DC voltage and operative to provide an inverter voltage at an inverter output, the inverter voltage having a frequency, the inverter means having control means operative in response to a control input to control this frequency;

gas discharge lamp means having: (i) main lamp terminals operative to receive main lamp operating power, and (ii) thermionic cathode means having cathode terminals operative to receive cathode heating power;

impedance means connected in circuit between the inverter output, the main lamp terminals, and the cathode terminals, the impedance means being operative to supply from the inverter output main lamp operating power to the main lamp terminals and cathode heating power to the cathode terminals, the amount of main lamp operating power and the amount of cathode heating power supplied both being dependent on the frequency of the inverter voltage; and control means operative to provide the control input in such manner as to control the frequency of the inverter voltage between a first frequency and a second frequency;

such that the arrangement is operative to provide: (i) a substantive amount of cathode heating power but only a negligible amount of main lamp operating power at the first frequency, and (ii) a negligible amount of cathode heating power but a substantive amount of lamp operating power at the second frequency.

8. An arrangement comprising:

inverter means connected with a source of DC voltage and operative to provide an inverter voltage at an inverter output, the inverter voltage having a frequency, the inverter means having control means operative in response to a control input to control this frequency;

gas discharge lamp means having: (i) main lamp terminals operative to receive main lamp operating power, and (ii) thermionic cathode means having cathode terminals operative to receive cathode heating power;

impedance means connected in circuit between the inverter output, the main lamp terminals, and the cathode terminals, the impedance means being operative to supply from the inverter output main lamp operating power to the main lamp terminals and cathode heating power to the cathode terminals, the magnitude of the main lamp operating voltage and the magnitude of the cathode heating voltage both being dependent on the frequency of the inverter voltage; and control means operative to provide the control input in such manner as to control the frequency of the inverter voltage between a first frequency and a second frequency;

such that the arrangement is operative to provide: (i) at the first frequency, a substantive magnitude of cathode heating voltage but only a negligible magnitude of main lamp operating voltage, and (ii) at the second frequency, a substantive magnitude of main lamp operating voltage.

9. In a power supply means connected with and operative to power a gas discharge lamp, the lamp having a pair of main lamp terminals and a cathode, the cathode having a pair of cathode terminals, an improvement comprising:

(1) control input means operative in response to a control input to cause the power supply means to function in either of two modes:

(a) a first mode wherein: (i) a first cathode voltage is provided to the cathode terminals, and (ii) a first lamp voltage is provided to the main lamp terminals, the magnitude of the first lamp voltage being insufficient to cause lamp ignition; and (b) a second mode wherein: (i) a second cathode voltage is provided to the cathodes, the magnitude of the second cathode voltage being substantially lower than that of the first cathode voltage, and (ii) a second lamp voltage is provided to the main lamp terminals, the magnitude of the second lamp voltage being sufficient to cause lamp ignition; and (2) control output means connected with the control input means and operative to provide the control input, thereby to cause the power supply means to exist in the first mode for a period of time before causing it to change to the second mode.

10. The improvement of claim 9 wherein the magnitude of the second lamp voltage is substantially larger than that of the first lamp voltage.

11. The improvement of claim 9 wherein the first lamp voltage has a first frequency and the second lamp voltage has a second frequency, the first frequency being different from the second frequency.

12. An arrangement comprising:

power supply means operative to power a gas discharge lamp, the gas discharge lamp having a pair of main lamp terminals and a thermionic cathode, the thermionic cathode having a pair of cathode terminals, the power supply means having: (i) a first and a second pair of output terminals operative, respectively, to connect with the main lamp terminals and the cathode terminals and to provide thereto, respectively, a main lamp voltage and a cathode voltage, and (ii) control input means receptive of a control input and operative in response thereto to control the magnitude of the main lamp voltage; and control output means connected with the control input means and operative to provide the control input such as to cause the power supply means to exist in either of two modes:

(1) a first mode in which: (i) the cathode voltage is of a first magnitude sufficient to cause the thermionic cathode to become incandescent, and (ii) the main lamp voltage is of a magnitude sufficient to cause the gas discharge lamp to ignite; and (2) a second mode in which: (i) the cathode voltage is of a second magnitude, the second magnitude being substantially lower than the first magnitude, and (ii) the main lamp voltage is of a magnitude sufficient to cause the gas discharge lamp to ignite.

13. The arrangement of claim 12 wherein: (i) at any given time, the frequency of the main lamp voltage is the same as that of the cathode voltage, and (ii) the frequency of the main lamp voltage during the first mode is different from the frequency of the main lamp voltage during the second mode.

14. The arrangement of claim 12 wherein the control input means is operative to control the magnitude of the main lamp voltage by way of controlling its frequency.

15. The arrangement of claim 12 wherein the power supply comprises tuned circuit means.

16. An arrangement comprising:

inverter operative to provide an inverter output voltage at an inverter output means; the inverter having switching transistor means including transistor drive input means; the inverter being self-oscillating by way of positive feedback means connected in circuit between the inverter output means and the transistor drive input means; the inverter having frequency control input means operative, on receipt of a control signal, to control the frequency of the inverter output voltage;

gas discharge lamp having: (i) main lamp terminals receptive of a main lamp voltage, and (ii) a thermionic cathode having cathode terminals receptive of a cathode heating voltage;

frequency-discriminating circuit means connected between: (i) the inverter output means, (ii) the lamp input terminals, and (iii) the cathode terminals; the frequency-discriminating circuit means being operative to cause a cathode voltage to be applied at the cathode terminals and a main lamp voltage to be applied at the main lamp terminals; the magnitude of the cathode voltage being a first function of the frequency; the magnitude of the main lamp voltage being a second function of frequency; the second function being substantially different from the first function; and control means connected with the frequency control input means and operative to provide said control signal, thereby to cause the frequency of the inverter output voltage to vary such as: (i) initially to cause the cathode voltage to be of a first magnitude and the main lamp voltage to be of a second magnitude, such as to provide a sufficient amount of cathode heating power to the termionic cathode to reach incandescence without causing the gas discharge lamp to ignite, and (ii) subsequently, after the termionic cathode has reached incandescence, to cause the first magnitude to decrease by a substantial degree while at the same time to cause the second magnitude to increase substantially, thereby to cause the gas discharge lamp to ignite and operate while at the same time causing the amount of cathode heating power provided to the thermionic cathode to decrease to a substantial degree.

* * * * *

UNITED STATES PATENT AND TRADEMARK OFFICE

CERTIFICATE OF CORRECTION

PATENT NO. : 4,935,669

DATED : June 19, 1990

INVENTOR(S) : Ole K. Nilssen

It is certified that error appears in the above-indentified patent and that said Letters Patent is hereby corrected as shown below:

Claim 12, Column 9, line 22, "lamp voltage is of a magnitude sufficient to cause", should read --lamp voltage is of a magnitude insufficient to cause--.

Signed and Sealed this

Third Day of May, 1994

Bruce Lehman

*Attest:*

BRUCE LEHMAN

*Attesting Officer*

*Commissioner of Patents and Trademarks*